US010650993B1

(12) United States Patent
Kim et al.

(10) Patent No.: US 10,650,993 B1
(45) Date of Patent: May 12, 2020

(54) CIRCUIT BREAKER WITH ENHANCED ARC EXTINGUISHING CHAMBER

(71) Applicant: Siemens Industry, Inc., Alpharetta, GA (US)

(72) Inventors: Raiden Jay Kim, Buford, GA (US); Guang Yang, Johns Creek, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 16/357,513

(22) Filed: Mar. 19, 2019

(51) Int. Cl.
*H01H 33/18* (2006.01)
*H01H 33/72* (2006.01)
*H01H 71/12* (2006.01)

(52) U.S. Cl.
CPC ..... *H01H 33/182* (2013.01); *H01H 33/72* (2013.01); *H01H 71/12* (2013.01)

(58) Field of Classification Search
CPC ..... H01H 33/182; H01H 33/20; H01H 33/64; H01H 33/72; H01H 71/12; H01T 4/14
USPC ..... 218/22, 15, 23, 34, 36, 40, 46
See application file for complete search history.

(56) References Cited

U.S. PATENT DOCUMENTS 4,516,005 A * 5/1985 Gallatin ..... H01H 9/44 218/22
4,614,928 A * 9/1986 Westermeyer ..... H01H 73/18 218/32
4,764,650 A * 8/1988 Bur ..... H01H 73/18 200/281
5,756,951 A * 5/1998 Manthe ..... H01H 9/342 218/150
7,081,596 B2 * 7/2006 Schneider ..... H01H 1/2066 218/147
7,834,290 B2 * 11/2010 Birner ..... H01H 71/526 218/36
8,822,866 B2 * 9/2014 Fasano ..... H01H 9/36 218/154
2010/0072044 A1 * 3/2010 Meyer-Haack ..... H01H 1/5822 200/269

* cited by examiner

*Primary Examiner* — William A Bolton

(57) ABSTRACT

An electronic circuit breaker comprises an arc interruption mechanism that would enhance arc attraction to arc plates and would reduce the possibilities of an arc escaping from the arc plates. The arc interruption mechanism includes an enhanced arc extinguishing chamber. The arc extinguishing chamber includes a plurality of arc plates having first and second sides. The circuit breaker further comprises a stationary contact plate that includes a first arc runner disposed near the first side of the plurality of arc plates. The circuit breaker further comprises a load terminal that includes a second arc runner disposed near the second side of the plurality of arc plates. As an arc is attracted by the plurality of arc plates and the arc enters the plurality of arc plates, a length of a current path associated with the arc is reduced through the first arc runner and the second arc runner by reducing a resistance of the current path for the arc or by reducing a voltage across the circuit breaker.

16 Claims, 6 Drawing Sheets

CIRCUIT BREAKER WITH ENHANCED ARC EXTINGUISHING CHAMBER

BACKGROUND

1. Field

Aspects of the present invention generally relate to a circuit breaker with an arc extinguishing chamber.

2. Description of the Related Art

Recent development of an electronic tripping residential circuit breaker created a need for an arc interruption mechanism that can accommodate small contact separation gaps and can reduce arc erosion/contamination to the electronic components. Among several options, arc stack with arc plates is selected for its additional current limiting capability and its capability to work on both AC and DC applications. Arc plates are normally made of ferromagnetic materials, such as steel, and hence attract arcs with electromagnetic force. Once arc enters arc plates, it is split into multiple smaller arcs and the arc voltage can be significantly increased due to the extra arc anode-cathode pairs generated by plates. Current limiting is then achieved with the high arc voltage, and the arcs can be trapped within the plates to reduce erosion to other components.

Arc plates are widely used in low voltage circuit breakers, however, it has been noticed that the effectiveness of arc plates is heavily dependent to the design of circuit breaker, especially for circuit breakers with lower current ratings. This is mainly due to the physical properties of arcs themselves. When arc current is reduced, the electromagnetic force between arc and arc plates is greatly reduced. Also, with lower arc current, the path the arc travels on is cooler, which makes the arc less mobile to move from the contacts. These two factors together can affect the effectiveness of arc plates attracting arcs into them.

Once the arcs get into arc plates, whether they would stay in arc plates has also proven to be dependent on breaker designs. Steenbeck Minimum Principle states that arcs stay in states with lowest arc voltage possible. Although theoretically challenged by many, Steenbeck Minimum Principle agrees in general with observations. Inside arc plates, the arc voltage is greatly increased. Therefore, if not designed properly, arcs tend to breakdown again outside arc plates to reduce arc voltage, a so-called restrike. Many have attributed restrikes to the distributions of hot gases to areas outside arc plates. To overcome these technical challenges, many designs have been made to improve the arc plate attraction and to reduce possibilities of restrike, including gassing material, carefully designed current path to increase electromagnetic force and so on. Such solutions normally come with more costly material and/or more costly processes.

To the best of knowledge, gassing material and extra magnetic field (either by carefully designed current path, or by extra magnet) are the most common ways to increase effectiveness of arc plates attraction and arc trapping. In an interruption of an existing circuit breaker in which arc plates can be added, an arc is drawn between the two contacts and it results in a current path. Once the arc gets into the arc plates as the current path the arc is broken into several smaller arcs and arc voltage is increased. However, a common problem is that once the arc voltage is increased, a breakdown (restrike) can happen. Such restrikes can be described by Steenbeck Minimum Principle, where the arc seeks for the lowest voltage state possible, normally through the high temperature gas propagating inside the circuit breaker. If no other mechanism is applied, the arc would go to a shorter current path to keep voltage low. Failures have been observed due to internal parts erosion caused by restrikes. To minimize restrikes, a common approach is to apply a magnetic field, which adds additional electromagnetic force to the arc to keep it inside the arc plates, such magnetic field can be done with current loops or permanent magnet. However, problems with these designs still exist.

Therefore, there is a need of a better arc control and management mechanism in a circuit breaker.

SUMMARY

Briefly described, aspects of the present invention relate to an enhanced arc extinguishing chamber for a circuit breaker. An arc plates arrangement is proposed that would enhance arc attraction to the arc plates and would reduce the possibilities of arc escaping from the arc plates. A new current path arrangement and an arc plates arrangement is proposed in this invention. Two arc runners on opposing sides of arc plates are provided to reduce a length of a current path as an arc is attracted and enters the arc plates. Reducing "a length of a current path" can also be referred to as "reducing a resistance of an intended current path for an arc" or "reducing a voltage across a circuit breaker." A particular placement of the two parallel arc runners results in a desired current path. For attracting the arc, the two arc runners include narrow portions which operate as "hot spots" in order to make the arc more mobile through the two arc runners and enable its quick travel downwards.

In accordance with one illustrative embodiment of the present invention, a circuit breaker comprises an arc extinguishing chamber that includes a plurality of arc plates having first and second sides. The circuit breaker further comprises a stationary contact plate that includes a first arc runner disposed near the first side of the plurality of arc plates. The circuit breaker further comprises a load terminal that includes a second arc runner disposed near the second side of the plurality of arc plates. As an arc is attracted by the plurality of arc plates and the arc enters the plurality of arc plates, a length of a current path associated with the arc is reduced through the first arc runner and the second arc runner by reducing a resistance of the current path for the arc or by reducing a voltage across the circuit breaker.

In accordance with another illustrative embodiment of the present invention, a method to enhance arc extinguishing in a circuit breaker is provided. The method comprises providing an arc extinguishing chamber that includes a plurality of arc plates having first and second sides. The method further comprises providing a stationary contact plate that includes a first arc runner disposed near the first side of the plurality of arc plates. The method further comprises providing a load terminal that includes a second arc runner disposed near the second side of the plurality of arc plates. The method further comprises attracting an arc by the plurality of arc plates. The method further comprises reducing a length of a current path associated with the arc through the first arc runner and the second arc runner as the arc enters the plurality of arc plates.

In accordance with another illustrative embodiment of the present invention, a circuit breaker is provided. It comprises an arc extinguishing chamber that includes a plurality of arc plates having first and second sides. The circuit breaker further comprises a stationary contact plate that includes a first arc runner disposed near the first side of the plurality of arc plates. The circuit breaker further comprises a load terminal that includes a second arc runner disposed near the second side of the plurality of arc plates. The first arc runner comprises a plurality of first narrow portions to create a plurality of first hot spots and the second arc runner comprises a plurality of second narrow portions to create a plurality of second hot spots to increase arc mobility so the arc can travel down the plurality of arc plates quicker with a same amount of an electromagnetic force.

DETAILED DESCRIPTION

To facilitate an understanding of embodiments, principles, and features of the present invention, they are explained hereinafter with reference to implementation in illustrative embodiments. In particular, they are described in the context of an assembly of an arc extinguishing chamber of a circuit breaker with various components of an enhanced mechanism that would enhance arc attraction to arc plates and would reduce the possibilities of an arc escaping from the arc plates. The assembly is disposed in an arc extinguishing chamber disposed between a base and a cover of the circuit breaker. A reduced current path arrangement for an arc and an arc plates arrangement is provided, surrounded by a first arc runner and a second arc runner. Several or all of the arc plates may be extended into an empty area below the arc plates to provide further a desired current limiting capability. An arc runner may have a geometry having multiple narrow portions to create hot spots. A method to enhance arc extinguishing in a circuit breaker is provided. An electronic circuit breaker comprises an arc interruption mechanism that would enhance arc attraction to arc plates and would reduce the possibilities of an arc escaping from the arc plates. The arc interruption mechanism includes an enhanced arc extinguishing chamber. Examples of the circuit breaker include low voltage residential circuit breakers and electronic tripping residential circuit breakers. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
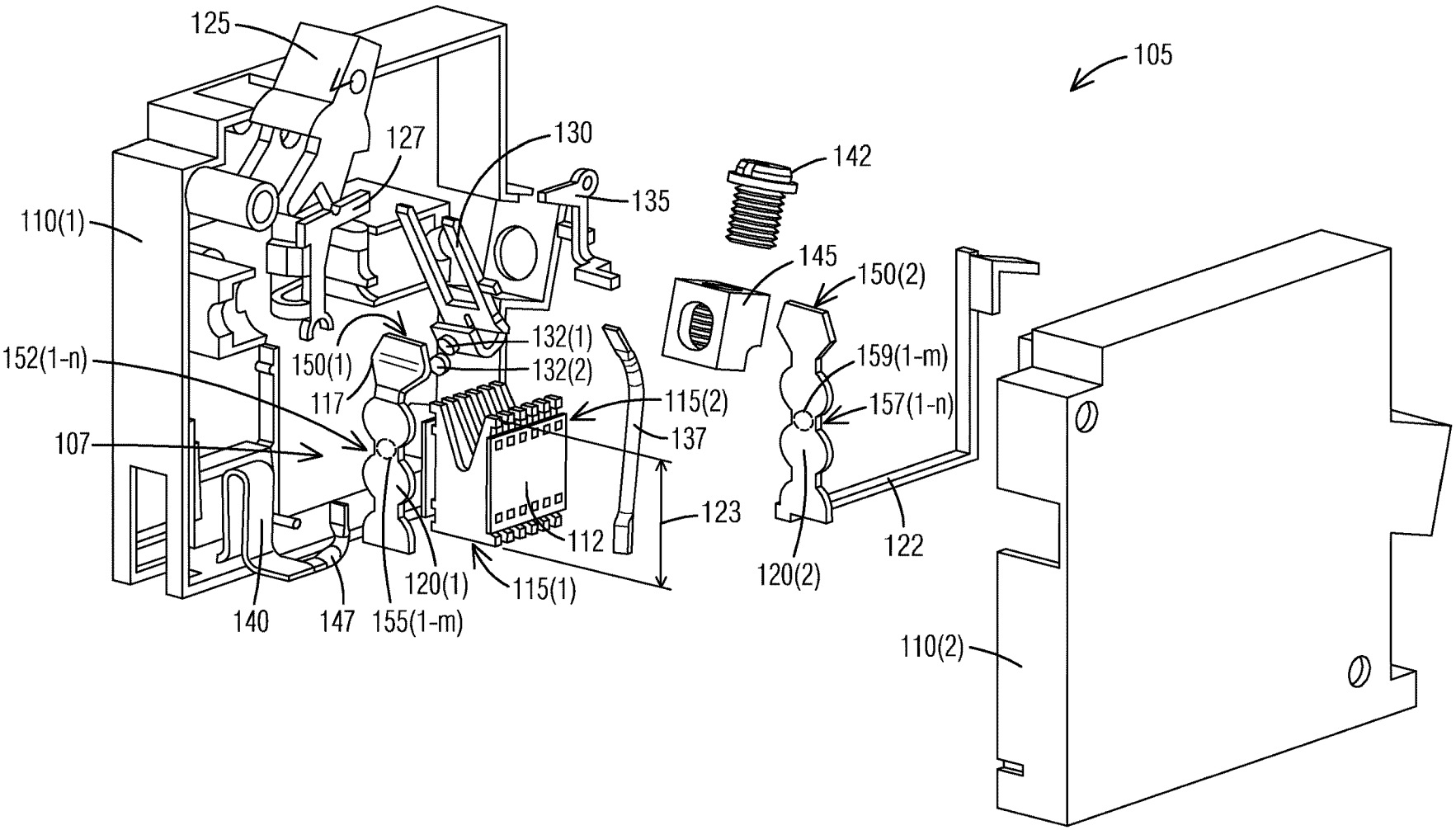
FIG. 1 illustrates an exploded view of a circuit breaker with an arc extinguishing chamber disposed between a base and a cover in accordance with an exemplary embodiment of the present invention.

Consistent with one embodiment of the present invention, FIG. 1 represents a representation of an exploded view of a circuit breaker 105 including an arc extinguishing chamber 107 disposed between a base 110(1) and a cover 110(2) in accordance with an exemplary embodiment of the present invention. The arc extinguishing chamber 107 includes a plurality of arc plates 112 having first and second sides 115(1, 2). The circuit breaker 105 further includes a stationary contact plate 117 that includes a first arc runner 120(1) disposed near the first side 115(1) of the plurality of arc plates 112. The circuit breaker 105 further includes a load terminal 122 that includes a second arc runner 120(2) disposed near the second side 115(2) of the plurality of arc plates 112. When an arc (not shown, see FIG. 4) is attracted by the plurality of arc plates 112 and the arc enters the plurality of arc plates 112, a length of a current path (not shown, see FIG. 4) associated with the arc is reduced through the first arc runner 120(1) and the second arc runner 120(2) by reducing a resistance of the current path for the arc or by reducing a voltage across the circuit breaker 105.

In one embodiment, the first arc runner 120(1) may be disposed substantially parallel to the first side 115(1) of the plurality of arc plates. Likewise, the second arc runner 120(2) may be disposed substantially parallel to the second side 115(2) of the plurality of arc plates 112. Consistent with one embodiment, the first arc runner 120(1) may be disposed around an entire height 123 of the plurality of arc plates. Similarly, the second arc runner 120(2) may be disposed around the entire height 123 of the plurality of arc plates 112.

The circuit breaker 105 further includes a handle 125, a cradle 127, a moving arm 130, a moving contact 132(1), an armature 135, a stationary contact 132(2), a load connecting braid 137, a line terminal 140, a lug 142, a bolt 145, and a line connecting braid 147. The stationary contact plate 117 includes the stationary contact 132(2) and the load terminal 122 includes the load connecting braid 137 coupled to the moving arm 130 having the moving contact 132(1) such that the first arc runner 120(1) and the second arc runner 120(2) each have a respective top end 150(1, 2) that ends below the stationary contact 132(2) and the moving contact 132(1).

In one embodiment, the first arc runner 120(1) comprises a plurality of first narrow portions 152(1-*n*) to create a plurality of first hot spots 155(1-*m*) and the second arc runner 120(2) comprises a plurality of second narrow portions 157(1-*n*) to create a plurality of second hot spots 159(1-*m*). The plurality of first narrow portions 152(1-*n*) and the plurality of second narrow portions 157(1-*n*) are designed to increase arc mobility so the arc can travel down the plurality of arc plates 112 quicker with a same amount of an electromagnetic force. The plurality of first narrow portions 152(1-*n*) and the plurality of second narrow portions 157(1-*n*) effectively heat up during a high current event and create a smoother arc motion as the arc is more mobile when the first arc runner 120(1) and the second arc runner 120(2) are at a high temperature.

Figure 2:
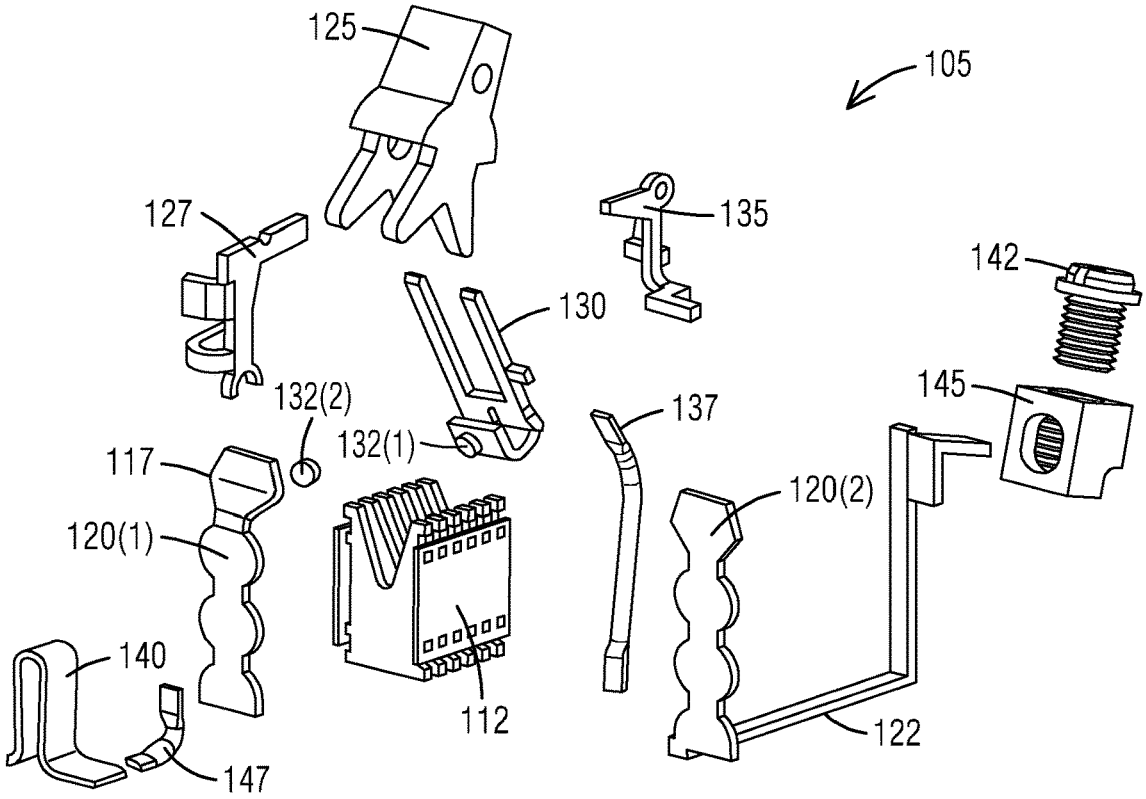
FIG. 2 illustrates an exploded view of a circuit breaker with an arc extinguishing chamber shown without a base and a cover in accordance with an exemplary embodiment of the present invention.
Figure 3:
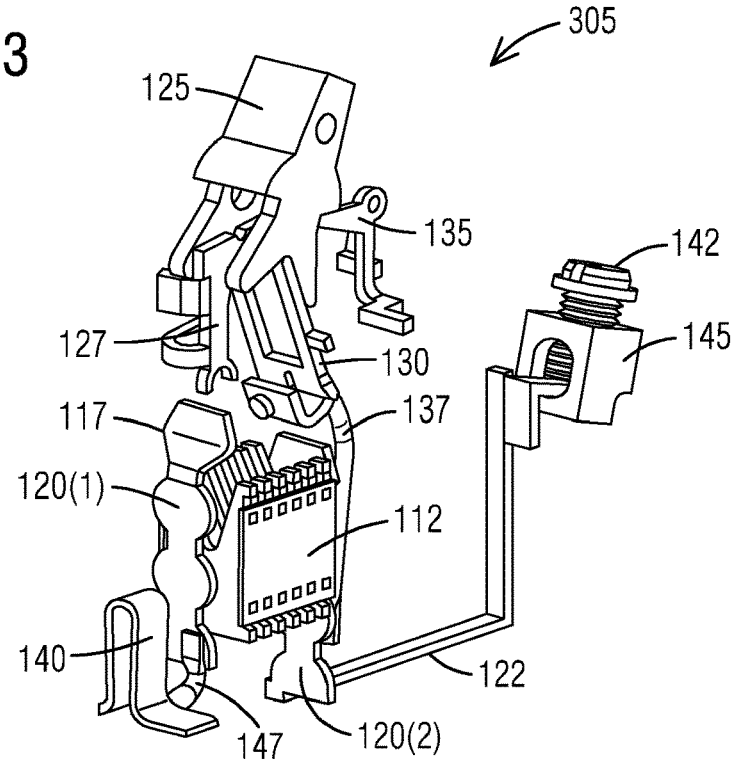
FIG. 3 illustrates an assembly of an arc extinguishing chamber of a circuit breaker with various components of an enhanced mechanism that would enhance arc attraction to the arc plates and would reduce the possibilities of the arc escaping from the arc plates in accordance with an exemplary embodiment of the present invention.

Referring to FIG. 2, it illustrates an exploded view of the circuit breaker 105 with the arc extinguishing chamber 107 shown without the base 110(1) and the cover 110(2) in accordance with an exemplary embodiment of the present invention. Turning now to FIG. 3, it illustrates an assembly 305 of the arc extinguishing chamber 107 of the circuit breaker 105 with various components of an enhanced mechanism that would enhance arc attraction to the arc plates 112 and would reduce the possibilities of the arc escaping from the arc plates 112 in accordance with an exemplary embodiment of the present invention.

Figure 4:
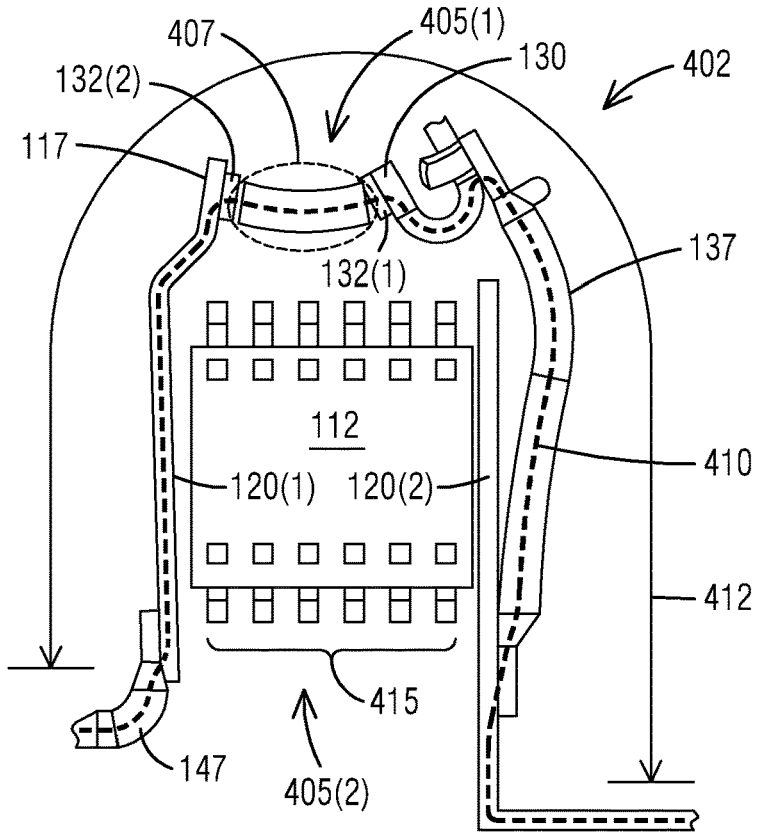
FIG. 4 illustrates a reduced current path arrangement for an arc at the moment of contact separation and an arc plates arrangement surrounded by a first arc runner and a second arc runner in accordance with an exemplary embodiment of the present invention.

FIG. 4 illustrates an arc interruption mechanism 402 with a reduced current path arrangement 405(1) for an arc 407 at the moment of contact separation and an arc plates arrangement 405(2) surrounded by the first arc runner 120(1) and the second arc runner 120(2) in accordance with an exemplary embodiment of the present invention. The first arc runner 120(1) and the second arc runner 120(2) are arranged in the reduced current path arrangement 405(1) that reduces restrike, enhances arc trapping and increases arc mobility so the arc can travel down the plurality of arc plates 112 quicker with a same amount of an electromagnetic force. The plurality of arc plates 112 is arranged in the arc plates arrangement 405(2) that reduces amount of a hot gas going back to a contact area and cools down the hot gas as it passes through the plurality of arc plates 112 and reduces a possibility for restrike.

Figure 5:
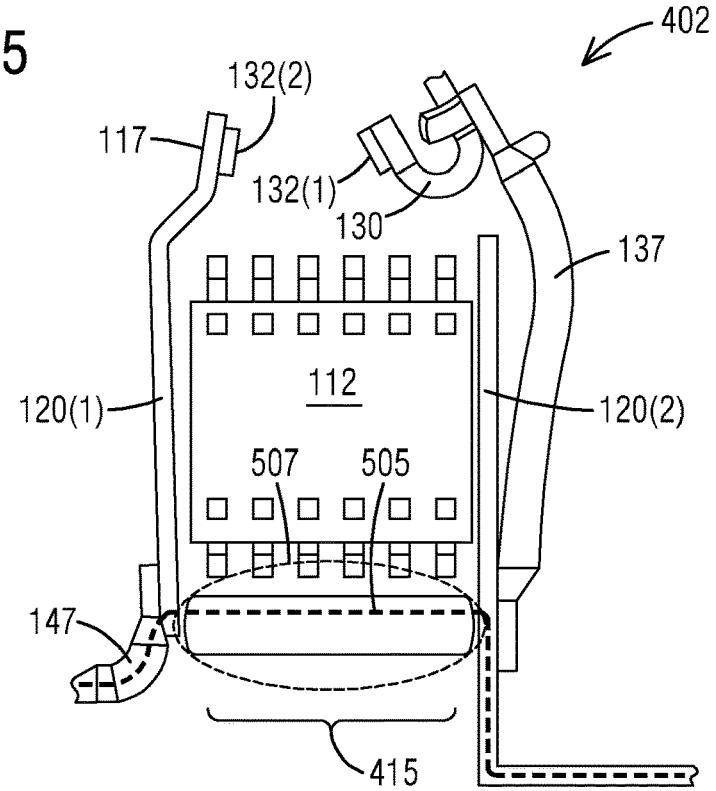
FIG. 5 illustrates a reduced current path for the arc in an empty area in accordance with an exemplary embodiment of the present invention.

As shown in FIG. 4, a new current path and a new arc plates arrangement is proposed in this invention. FIG. 4 shows an interruption with the arc 407 drawn between two contacts 132(1-2), and a current path 410 is shown with a dashed line. As the arc 407 is attracted by the arc plates 112 and enters the arc plates 112, a length 412 of the current path 410 reduces. In a design arrangement of an existing circuit breaker, the length of the current path increases as the arc is entering the arc plates. After the arc 407 passes the arc plates 112 into a lower empty area 415 (as shown in FIG. 5), the current path 410 is naturally shorter than in FIG. 4. Therefore, the arc 407 would stay in this lower empty area 415 instead of restriking back between the two contacts 132(1-2). Another significant aspect of the reduced current path arrangement 405(1) and the arc plates arrangement 405(2) is that it reduces the amount of a hot gas going back to the contact area, and hence reduces the possibility for a restrike.

As seen in FIG. 5, it illustrates a reduced current path 505 for an arc 507 in the lower empty area 415 in accordance with an exemplary embodiment of the present invention. For a hot gas in FIG. 5 to travel back between the contacts 132(1-2), it has to pass through the arc plates 112, which can significantly cool down the hot gas. Depending on a current level the circuit breaker 105 is subject to interrupt, the arc plates 112 can extend into the lower empty area 415 for current limiting purposes. If the main concern of the circuit breaker 105 is arc contamination instead of high let through current, FIG. 5 can be used with the empty area 415.

Figure 6:
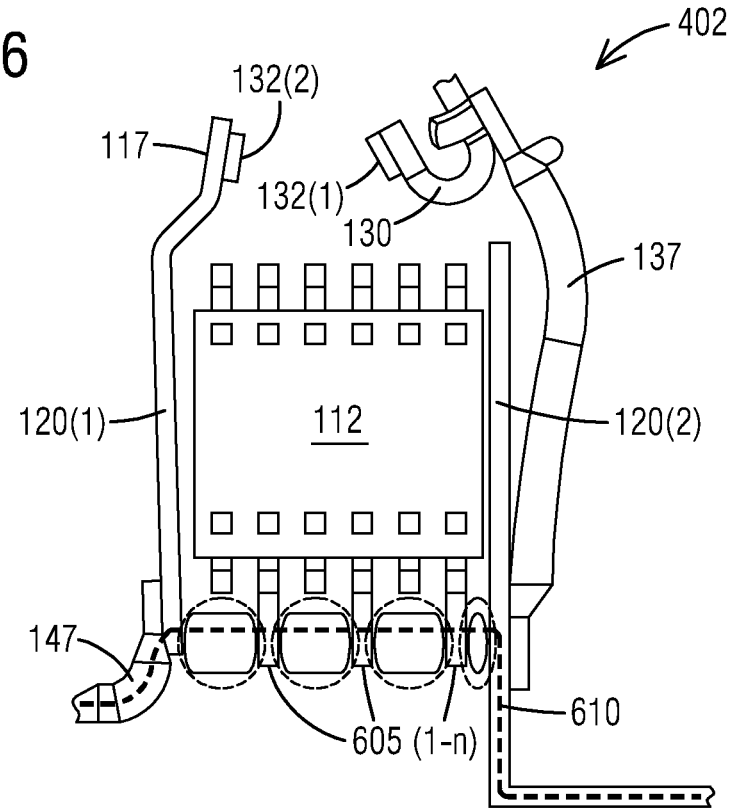
FIG. 6 illustrates several (or all, not shown) of the arc plates extended into the empty area to provide further a desired current limiting capability in accordance with an exemplary embodiment of the present invention.

As shown in FIG. 6, it illustrates several (or all, not shown) of arc plates 605(1-*n*) are extended into the empty area 415 to provide further a desired current limiting capability in accordance with an exemplary embodiment of the present invention. Some or all of the plurality of arc plates 112 may be extended near a bottom end of the plurality of arc plates 112 to further enhance a current 610 limiting capability. The more the plates means the higher the arc voltage and the lower the let through current 610.

Figure 7:
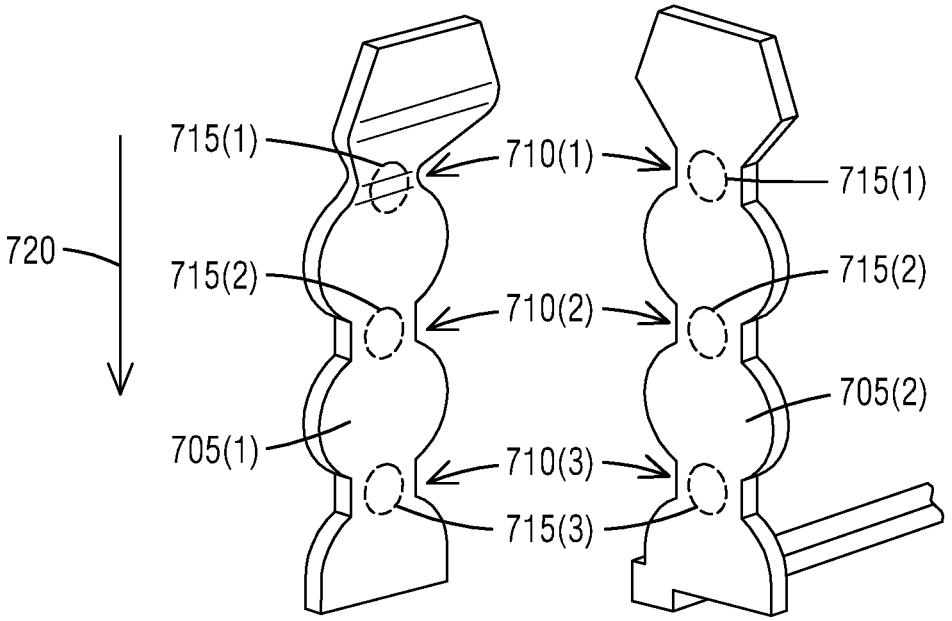
FIG. 7 illustrates a schematic of an arc runner with its geometry shown having multiple narrow portions to create hot spots in accordance with an exemplary embodiment of the present invention.

In FIG. 7, it illustrates a schematic of arc runners 705(1-2) with their geometry shown having multiple narrow portions 710(1-3) to create hot spots 715(1-3) in accordance with an exemplary embodiment of the present invention. Additional to the capability to reduce restrike and to enhance arc trapping, the present invention also proposes a current path structure that increases arc mobility, so the arc 407 can travel down the arc plates 112 quicker with the same amount of electromagnetic force. The arc 407 is more mobile when the electrodes are at high temperature. In this embodiment, the arc runners 705 on the two sides of the arc plates 112 are shaped as shown in FIG. 7, with the narrow portions 710(1-3) in a current path 720. Such narrow portions 710(1-3) can effectively heat up during high current and create smoother arc motion. Various shape designs can be used to accommodate different ratings and to provide additional electromagnetic force to arc roots.

Figure 8:
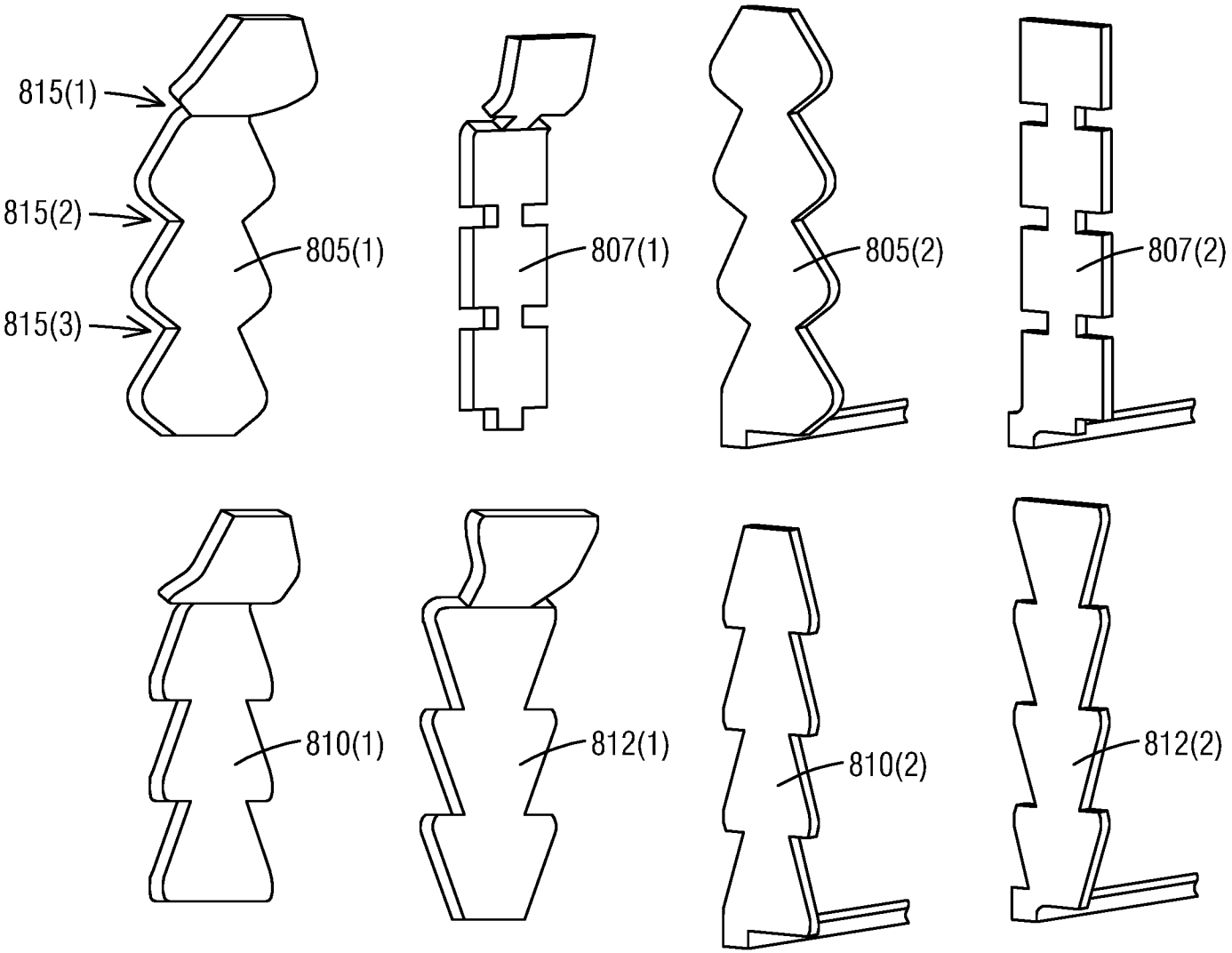
FIG. 8 illustrates different geometries for arc runners in accordance with an exemplary embodiment of the present invention.

FIG. 8 illustrates different geometries for four arc runner pairs 805(1-2), 807(1-2), 810(1-2), 812(1-2) in accordance with an exemplary embodiment of the present invention. For example, the arc runner 805(1) includes narrow portions 815(1-3). The location of these narrow portions 815(1-3), a number of narrow portions 815(1-3) and a width of narrow portions 815(1-3) may be varied based on different ratings of the circuit breaker 105.

Most existing approaches are to increase the forces to the arc 407, and then force the arc 407 into the arc plates 112. The clear drawback of such approaches is that the arc 407 is in a "tension" state and would go back to a "relaxing" state as soon as the forcing mechanism is gone. Therefore, the arc 407 cannot be trapped if a circuit breaker does not provide consistent forcing mechanism. However, the proposed approach is to make the arc 407 between the contacts 132(1-2) a "tension" state, and to make an arc trapping area a "relaxing" state. Therefore, the arc 407 would reach the arc trapping area naturally. Such approach uses arc's own physical properties and will be more efficient. Also, it does not require the extra mechanism for extra force, such as a magnet and a gassing material. Therefore, it is more cost friendly.

Figure 9:
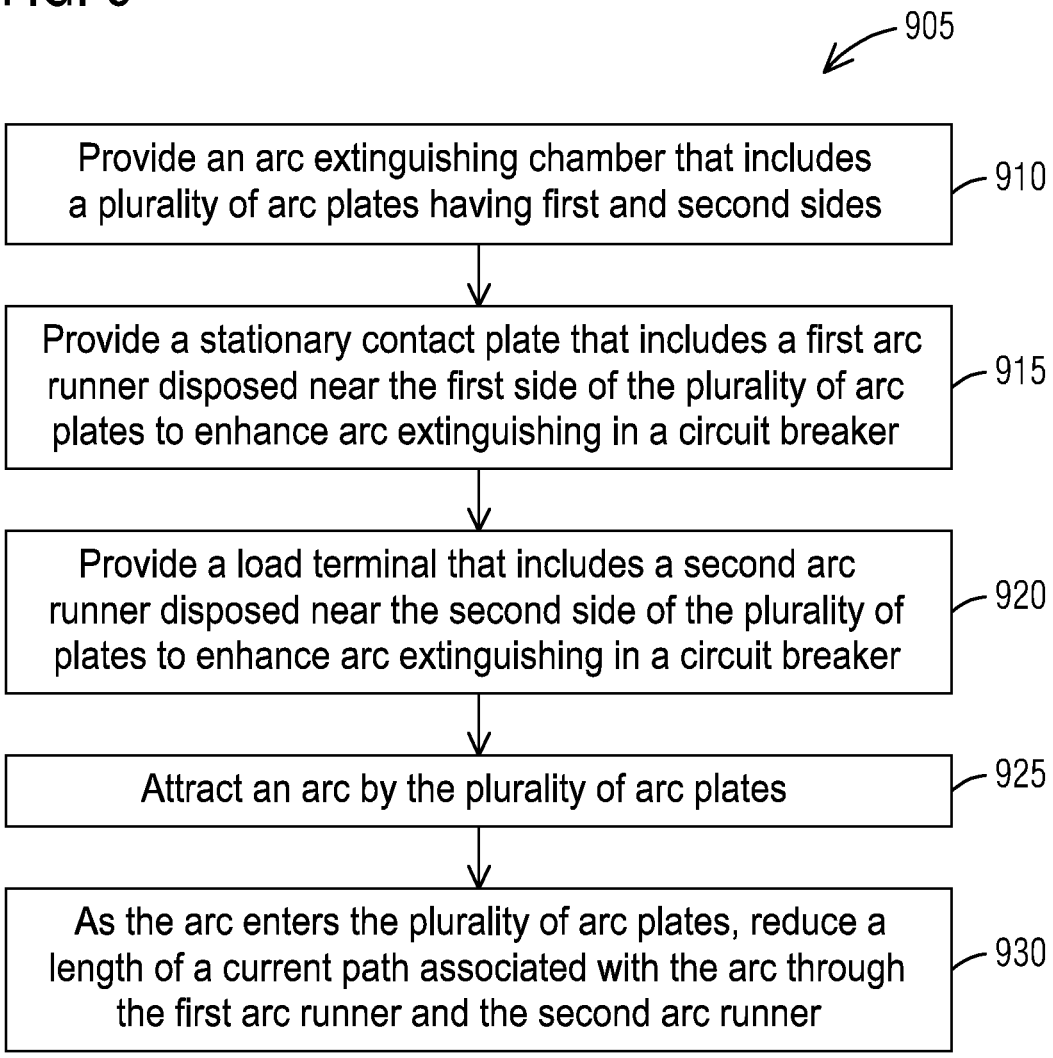
FIG. 9 illustrates a schematic view of a flow chart of a method to enhance arc extinguishing in a circuit breaker in accordance with an exemplary embodiment of the present invention.

FIG. 9 illustrates a schematic view of a flow chart of a method 905 to enhance arc extinguishing in the circuit breaker 105 in accordance with an exemplary embodiment of the present invention. Reference is made to the elements and features described in FIGS. 1-8. It should be appreciated that some steps are not required to be performed in any particular order, and that some steps are optional.

The method 905 comprises a step 910 of providing the arc extinguishing chamber 107 that includes the plurality of arc plates 112 having first and second sides 115(1-2). The method 905 further comprises a step 915 of providing a stationary contact plate that includes the first arc runner 120(1) disposed near the first side of the plurality of arc plates 112. The method 905 further comprises a step 920 of providing a load terminal that includes the second arc runner 120(2) disposed near the second side of the plurality of arc plates 112. The method 905 further comprises a step 925 of attracting the arc 407 by the plurality of arc plates 112. The method 905 comprises a step 930 of reducing a length of the current path 410 associated with the arc 407 through the first arc runner 120(1) and the second arc runner 120(2) as the arc 407 enters the plurality of arc plates 112.

The method 905 further comprises disposing the first arc runner 120(1) substantially parallel to the first side of the plurality of arc plates 112. The method 905 further comprises disposing the second arc runner 120(2) substantially parallel to the second side of the plurality of arc plates 112. The method 905 further comprises disposing the first arc runner 120(1) around an entire height of the plurality of arc plates 112. The method 905 further comprises disposing the second arc runner 120(2) around the entire height of the plurality of arc plates 112.

The method 905 further comprises extending some or all of the plurality of arc plates 112 near a bottom end of the plurality of arc plates 112 to further enhance a current limiting capability. The method 905 further comprises arranging the plurality of arc plates 112 in an arc plate arrangement that reduces amount of a hot gas going back to a contact area and cools down the hot gas as it passes through the plurality of arc plates 112 and reduces a possibility for restrike. The method 905 further comprises arranging the first arc runner 120(1) and the second arc runner 120(2) in a current path arrangement that reduces restrike, enhances arc trapping and increases arc mobility so the arc can travel down the plurality of arc plates 112 quicker with a same amount of an electromagnetic force.

While an electronic tripping residential circuit breaker with an arc interruption mechanism that can accommodate small contact separation gaps and can reduce arc erosion/contamination to the electronic components is described here a range of one or more other types of arc interruption mechanisms or other forms of arc interruption mechanisms are also contemplated by the present invention. For example, other types of arc interruption mechanisms may be implemented based on one or more features presented above without deviating from the spirit of the present invention.

The techniques described herein can be particularly useful for low voltage residential circuit breakers. While particular embodiments are described in terms of the low voltage residential circuit breakers, the techniques described herein are not limited to low voltage residential circuit breakers but can also be used with other circuit breakers.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A circuit breaker comprising:

an arc extinguishing chamber that includes a plurality of arc plates having first and second sides;

a stationary contact plate that includes a first arc runner disposed near the first side of the plurality of arc plates;

a load terminal that includes a second arc runner disposed near the second side of the plurality of arc plates, wherein as an arc is attracted by the plurality of arc plates and the arc enters the plurality of arc plates, a length of a current path associated with the arc is reduced through the first arc runner and the second arc runner by reducing a resistance of the current path for the arc or by reducing a voltage across the circuit breaker, and wherein the first arc runner comprises a plurality of first narrow portions to create a plurality of first hot spots and the second arc runner comprises a plurality of second narrow portions to create a plurality of second hot spots.

2. The circuit breaker of claim 1, wherein the first arc runner is disposed substantially parallel to the first side of the plurality of arc plates.

3. The circuit breaker of claim 2, wherein the second arc runner is disposed substantially parallel to the second side of the plurality of arc plates.

4. The circuit breaker of claim 3, wherein the first arc runner is disposed around an entire height of the plurality of arc plates.

5. The circuit breaker of claim 4, wherein the second arc runner is disposed around the entire height of the plurality of arc plates.

6. The circuit breaker of claim 1, wherein some or all of the plurality of arc plates are extended near a bottom end of the plurality of arc plates to further enhance a current limiting capability.

7. The circuit breaker of claim 1, wherein the plurality of arc plates is arranged in an arc plate arrangement that reduces amount of a hot gas going back to a contact area and cools down the hot gas as it passes through the plurality of arc plates and reduces a possibility for restrike.

8. The circuit breaker of claim 1, wherein the first arc runner and the second arc runner are arranged in a current path arrangement that reduces restrike, enhances arc trapping and increases arc mobility so the arc can travel down the plurality of arc plates quicker with a same amount of an electromagnetic force.

9. A method to enhance arc extinguishing in a circuit breaker, the method comprising:

providing an arc extinguishing chamber that includes a plurality of arc plates having first and second sides;

providing a stationary contact plate that includes a first arc runner disposed near the first side of the plurality of arc plates;

providing a load terminal that includes a second arc runner disposed near the second side of the plurality of arc plates;

attracting an arc by the plurality of arc plates; and as the arc enters the plurality of arc plates, reducing a length of a current path associated with the arc through the first arc runner and the second arc runner, wherein the first arc runner comprises a plurality of first narrow portions to create a plurality of first hot spots and the second arc runner comprises a plurality of second narrow portions to create a plurality of second hot spots.

10. The method of claim 9, further comprising:

disposing the first arc runner substantially parallel to the first side of the plurality of arc plates; and disposing the second arc runner substantially parallel to the second side of the plurality of arc plates.

11. The method of claim 10, further comprising:

disposing the first arc runner around an entire height of the plurality of arc plates; and disposing the second arc runner around the entire height of the plurality of arc plates.

12. The method of claim 9, further comprising:

extending some or all of the plurality of arc plates near a bottom end of the plurality of arc plates to further enhance a current limiting capability.

13. The method of claim 9, further comprising:

arranging the plurality of arc plates in an arc plate arrangement that reduces amount of a hot gas going back to a contact area and cools down the hot gas as it passes through the plurality of arc plates and reduces a possibility for restrike; and arranging the first arc runner and the second arc runner in a current path arrangement that reduces restrike, enhances arc trapping and increases arc mobility so the arc can travel down the plurality of arc plates quicker with a same amount of an electromagnetic force.

14. A circuit breaker comprising:

an arc extinguishing chamber that includes a plurality of arc plates having first and second sides;

a stationary contact plate that includes a first arc runner disposed near the first side of the plurality of arc plates;

a load terminal that includes a second arc runner disposed near the second side of the plurality of arc plates, wherein the first arc runner comprises a plurality of first narrow portions to create a plurality of first hot spots and the second arc runner comprises a plurality of second narrow portions to create a plurality of second hot spots to increase arc mobility so the arc can travel down the plurality of arc plates quicker with a same amount of an electromagnetic force.

15. The circuit breaker of claim 14, wherein the plurality of first narrow portions and the plurality of second narrow portions effectively heat up during a high current event and create a smoother arc motion as the arc is more mobile when the first arc runner and the second arc runner are at a high temperature.

16. The circuit breaker of claim 15, wherein the first arc runner is disposed substantially parallel to the first side of the plurality of arc plates, wherein the second arc runner is disposed substantially parallel to the second side of the plurality of arc plates, wherein the first arc runner is disposed around an entire height of the plurality of arc plates, and wherein the second arc runner is disposed around the entire height of the plurality of arc plates.

* * * * *